US008106842B2

(12) United States Patent
Norin

(10) Patent No.: US 8,106,842 B2
(45) Date of Patent: Jan. 31, 2012

(54) KA/KU ANTENNA ALIGNMENT

(75) Inventor: John L. Norin, Redondo Beach, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 231 days.

(21) Appl. No.: 12/634,530

(22) Filed: Dec. 9, 2009

(65) Prior Publication Data

US 2010/0085256 A1 Apr. 8, 2010

Related U.S. Application Data

(62) Division of application No. 11/545,845, filed on Oct. 11, 2006, now Pat. No. 7,636,067.

(60) Provisional application No. 60/725,781, filed on Oct. 12, 2005, provisional application No. 60/725,782, filed on Oct. 12, 2005, provisional application No. 60/726,337, filed on Oct. 12, 2005, provisional application No. 60/726,338, filed on Oct. 12, 2005, provisional application No. 60/726,118, filed on Oct. 12, 2005, provisional application No. 60/726,151, filed on Oct. 12, 2005, provisional application No. 60/726,150, filed on Oct. 12, 2005, provisional application No. 60/726,149, filed on Oct. 12, 2005, provisional application No. 60/727,143, filed on Oct. 14, 2005, provisional application No. 60/754,737, filed on Dec. 28, 2005, provisional application No. 60/758,762, filed on Jan. 13, 2006.

(51) Int. Cl.
*H01Q 3/00* (2006.01)

(52) U.S. Cl. ..... 343/760; 342/359

(58) Field of Classification Search ..... 343/757, 343/758, 761, 763, 760; 342/359, 372, 424
See application file for complete search history.

(56) References Cited

U.S. PATENT DOCUMENTS

| | | | |
|---|---|---|---|
| 4,656,486 | A | 4/1987 | Turner |
| 4,860,021 | A | 8/1989 | Kurosawa et al. |
| 5,313,215 | A | 5/1994 | Walker et al. |
| 5,617,107 | A | 4/1997 | Fleming |

(Continued)

FOREIGN PATENT DOCUMENTS

WO WO 2004/054128 6/2004

OTHER PUBLICATIONS

Notice of Allowance dated Sep. 30, 2009 in U.S. Appl. No. 11/545,846, filed Oct. 11, 2006 by John Norin et al.

(Continued)

*Primary Examiner* — Hoanganh Le

(57) ABSTRACT

A method, apparatus and system for aligning an antenna reflector with satellites in a satellite configuration. A system in accordance with the present invention comprises an alignment mechanism, coupled to the reflector, wherein the alignment mechanism comprises adjustments in azimuth, elevation, and skew, wherein the alignment mechanism is used to provide a first alignment to the satellite configuration, and a tool, used to access a database, wherein the database, comprises data related to satellite configuration positional data, including a position of at least one satellite in the satellite configuration at a given point in time, data related to the antenna, including at least data related to an alignment mechanism coupled to the antenna, data related to polarizations and frequencies of signals being transmitted by the satellite configuration, and data related to the geoposition of the antenna being aligned, wherein the database calculates at least one offset for the alignment of the reflector, wherein the at least one offset is used to reposition the antenna using the alignment mechanism.

20 Claims, 9 Drawing Sheets

U.S. PATENT DOCUMENTS

| | | | |
|---|---|---|---|
| 5,734,356 | A | 3/1998 | Chang |
| 5,787,335 | A | 7/1998 | Novak |
| 5,898,680 | A | 4/1999 | Johnstone et al. |
| 5,959,592 | A | 9/1999 | Petruzzelli |
| 5,982,333 | A | 11/1999 | Stillinger et al. |
| 6,011,597 | A | 1/2000 | Kubo |
| 6,188,372 | B1 | 2/2001 | Jackson et al. |
| 6,331,839 | B1 | 12/2001 | Grenell |
| 6,340,956 | B1 | 1/2002 | Bowen et al. |
| 6,424,817 | B1 | 7/2002 | Hadden |
| 6,441,797 | B1 | 8/2002 | Shah |
| 6,486,907 | B1 | 11/2002 | Farber |
| 6,580,391 | B1 | 6/2003 | Kepley et al. |
| 6,600,730 | B1 | 7/2003 | Davis et al. |
| 6,622,307 | B1 | 9/2003 | Ho |
| 6,653,981 | B2 | 11/2003 | Wang et al. |
| 6,693,587 | B1 | 2/2004 | Kuether et al. |
| 6,698,020 | B1 | 2/2004 | Zigmond et al. |
| 6,710,749 | B2 | 3/2004 | King |
| 6,728,513 | B1 | 4/2004 | Nishina |
| 6,762,727 | B2 | 7/2004 | Rochford et al. |
| 6,785,551 | B1 | 8/2004 | Richard |
| 6,864,855 | B1 | 3/2005 | Fujita |
| 6,879,301 | B2 | 4/2005 | Kozlovski |
| 6,906,673 | B1 | 6/2005 | Matz et al. |
| 6,965,343 | B1 | 11/2005 | Dybdal et al. |
| 6,968,206 | B1 | 11/2005 | Whitsey-Anderson |
| 7,095,378 | B1 | 8/2006 | Paquette |
| 7,162,200 | B2 | 1/2007 | Tsay et al. |
| 7,239,285 | B2 | 7/2007 | Cook |
| 7,437,123 | B2 | 10/2008 | Karabinis et al. |
| 7,663,543 | B2 | 2/2010 | Norin et al. |
| 7,791,552 | B1 | 9/2010 | Romanofsky |
| 2002/0003495 | A1 | 1/2002 | Johnstone et al. |
| 2002/0084941 | A1 | 7/2002 | Matz et al. |
| 2003/0023978 | A1 | 1/2003 | Bajgrowicz |
| 2003/0090412 | A1 | 5/2003 | Rao et al. |
| 2003/0122723 | A1 | 7/2003 | Luly et al. |
| 2003/0129960 | A1 | 7/2003 | Kato |
| 2003/0221191 | A1 | 11/2003 | Khusheim |
| 2004/0060065 | A1 | 3/2004 | James et al. |
| 2004/0128682 | A1 | 7/2004 | Liga et al. |
| 2004/0160375 | A1 | 8/2004 | King |
| 2004/0169114 | A1 | 9/2004 | Dierkes |
| 2004/0192190 | A1 | 9/2004 | Motoyama |
| 2004/0244035 | A1 | 12/2004 | Wright et al. |
| 2005/0052335 | A1 | 3/2005 | Chen |
| 2005/0057428 | A1 | 3/2005 | Fujita |
| 2005/0184923 | A1 | 8/2005 | Saito et al. |
| 2006/0012538 | A1* | 1/2006 | Waltman ..... 343/840 |
| 2006/0077097 | A1 | 4/2006 | Dybdal et al. |
| 2007/0072545 | A1 | 3/2007 | Karabinis et al. |
| 2007/0113243 | A1 | 5/2007 | Brey |
| 2009/0307728 | A1* | 12/2009 | Frank et al. ..... 725/68 |

OTHER PUBLICATIONS

Notice of Allowance dated Aug. 12, 2010 in U.S. Appl. No. 12/704,829, filed Feb. 12, 2010 by John L. Norin et al.

Final Rejection dated Apr. 11, 2011 in U.S. Appl. No. 11/971,808, filed Jan. 9, 2008 by Gustave R. Stroes et al.

DIRECTV Multi-Satellite Dish Antenna Installation Manual; DIRECTV, Inc.; 2003.

Configuration. (2007). In the American Heritage Dictionary of the English Language. Retrieved from http://www.credoreference.com/entry/hmdictenglang/configuration.

Constellation. (2007). In the American Heritage Dictionary of the English Language. Retrieved from http://www.credoreference.com/entry/hmdictenglang/constellation.

Notice of Allowance dated Jun. 16, 2011 in U.S. Appl. No. 11/971,808, filed Jan. 9, 2008 by Gustave R. Stroes et al.

Non-final Office action dated Nov. 3, 2010 in U.S. Appl. No. 11/971,808, filed Jan. 9, 2008 by Gustave R. Stroes et al.

Non-final Office action dated Sep. 16, 2010 in U.S. Appl. No. 11/971,800, filed Jan. 9, 2008 by Gustave R. Stroes et al.

Notice of Allowance dated Mar. 3, 2011 in U.S. Appl. No. 11/971,800, filed Jan. 9, 2008 by Gustave R. Stroes et al.

* cited by examiner

KA/KU ANTENNA ALIGNMENT

CROSS-REFERENCE TO RELATED APPLICATIONS

This application is a divisional application of U.S. patent application Ser. No. 11/545,845, filed Oct. 11, 2006, entitled KaKu ANTENNA ALIGNMENT by John L. Norin, which application is incorporated by reference herein, and which application claims the benefit under 35 U.S.C. §119(e) of the following co-pending and commonly-assigned U.S. provisional patent applications:

application Ser. No. 60/725,781, filed on Oct. 12, 2005 by John L. Norin and Kesse Ho, entitled "TRIPLE STACK COMBINING APPROACH TO Ka/Ku SIGNAL DISTRIBUTION;"

application Ser. No. 60/725,782, filed on Oct. 12, 2005 by Kesse Ho and John L. Norin, entitled "SINGLE LOCAL OSCILLATOR SHARING IN MULTI-BAND KA-BAND LNBS;"

application Ser. No. 60/726,151, filed on Oct. 12, 2005 by John L. Norin and Kesse Ho, entitled "BAND UPCONVERTER APPROACH TO KA/KU SIGNAL DISTRIBUTION;"

application Ser. No. 60/727,143, filed on Oct. 14, 2005 by John L. Norin and Kesse Ho, entitled "BAND UPCONVERTER APPROACH TO KA/KU SIGNAL DISTRIBUTION;"

application Ser. No. 60/728,338, filed on Oct. 12, 2005 by John L. Norin, Kesse Ho, Mike A. Frye, and Gustave Stroes, entitled "NOVEL ALIGNMENT METHOD FOR MULTI-SATELLITE CONSUMER RECEIVE ANTENNAS;"

application Ser. No. 60/726,118, filed on Oct. 12, 2005 by John L. Norin, entitled "KA/KU ANTENNA ALIGNMENT;"

application Ser. No. 60/726,149, filed on Oct. 12, 2005 by Kesse Ho, entitled "DYNAMIC CURRENT SHARING IN KA/KU LNB DESIGN;"

application Ser. No. 60/726,150, filed on Oct. 12, 2005 by Kesse Ho, entitled "KA LNB UMBRELLA SHADE;"

application Ser. No. 60/726,337, filed Oct. 12, 2005 by Michael A. Frye et al., entitled "ENHANCED BACK ASSEMBLY FOR KA/KU ODU;"

application Ser. No. 60/754,737, filed on Dec. 28, 2005 by John L. Norin, entitled "KA/KU ANTENNA ALIGNMENT;" and application Ser. No. 60/758,762, filed on Jan. 13, 2006 by Kesse Ho, entitled "KA LNB UMBRELLA SHADE," all of which applications are incorporated by reference herein.

BACKGROUND OF THE INVENTION

1. Field of the Invention

The present invention relates generally to a satellite receiver system, and in particular, to an alignment method for multi-band consumer receiver antennas.

2. Description of the Related Art

Satellite broadcasting of communications signals has become commonplace. Satellite distribution of commercial signals for use in television programming currently utilizes multiple feedhorns on a single Outdoor Unit (ODU) which supply signals to up to eight IRDs on separate cables from a multiswitch.

FIG. 1 illustrates a typical satellite television installation of the related art.

System 100 uses signals sent from Satellite A (SatA) 102, Satellite B (SatB) 104, and Satellite C (SatC) 106 (with transponders 28, 30, and 32 converted to transponders 8, 10, and 12, respectively), that are directly broadcast to an Outdoor Unit (ODU) 108 that is typically attached to the outside of a house 110. ODU 108 receives these signals and sends the received signals to IRD 112, which decodes the signals and separates the signals into viewer channels, which are then passed to television 114 for viewing by a user. There can be more than one satellite transmitting from each orbital location.

Satellite uplink signals 116 are transmitted by one or more uplink facilities 118 to the satellites 102-106 that are typically in geosynchronous orbit. Satellites 102-106 amplify and rebroadcast the uplink signals 116, through transponders located on the satellite, as downlink signals 120. Depending on the satellite 102-106 antenna pattern, the downlink signals 120 are directed towards geographic areas for reception by the ODU 108.

Each satellite 102-106 broadcasts downlink signals 120 in typically thirty-two (32) different sets of frequencies, often referred to as transponders, which are licensed to various users for broadcasting of programming, which can be audio, video, or data signals, or any combination. These signals have typically been located in the Ku-band Fixed Satellite Service (FSS) and Broadcast Satellite Service (BSS) bands of frequencies in the 10-13 GHz range. Future satellites will likely also broadcast in a portion of the Ka-band with frequencies of 18-21 GHz FIG. 2 illustrates a typical ODU of the related art.

ODU 108 typically uses reflector dish 122 and feedhorn assembly 124 to receive and direct downlink signals 120 onto feedhorn assembly 124. Reflector dish 122 and feedhorn assembly 124 are typically mounted on bracket 126 and attached to a structure for stable mounting. Feedhorn assembly 124 typically comprises one or more Low Noise Block converters 128, which are connected via wires or coaxial cables to a multiswitch, which can be located within feedhorn assembly 124, elsewhere on the ODU 108, or within house 110. LNBs typically downconvert the FSS and/or BSS-band, Ku-band, and Ka-band downlink signals 120 into frequencies that are easily transmitted by wire or cable, which are typically in the L-band of frequencies, which typically ranges from 950 MHz to 2150 MHz. This downconversion makes it possible to distribute the signals within a home using standard coaxial cables.

The multiswitch enables system 100 to selectively switch the signals from SatA 102, SatB 104, and SatC 106, and deliver these signals via cables 124 to each of the IRDs 112A-D located within house 110. Typically, the multiswitch is a five-input, four-output (5×4) multiswitch, where two inputs to the multiswitch are from SatA 102, one input to the multiswitch is from SatB 104, and one input to the multiswitch is a combined input from SatB 104 and SatC 106. There can be other inputs for other purposes, e.g., off-air or other antenna inputs, without departing from the scope of the present invention. The multiswitch can be other sizes, such as a 6×8 multiswitch, if desired. SatB 104 typically delivers local programming to specified geographic areas, but can also deliver other programming as desired.

To maximize the available bandwidth in the Ku-band of downlink signals 120, each broadcast frequency is further divided into polarizations. Each LNB 128 can receive both orthogonal polarizations at the same time with parallel sets of electronics, so with the use of either an integrated or external multiswitch, downlink signals 120 can be selectively filtered out from travelling through the system 100 to each IRD 112A-D.

IRDs 112A-D currently use a one-way communications system to control the multiswitch. Each IRD 112A-D has a dedicated cable 124 connected directly to the multiswitch, and each IRD independently places a voltage and signal combination on the dedicated cable to program the multiswitch. For example, IRD 112A may wish to view a signal that is provided by SatA 102. To receive that signal, IRD 112A sends a voltage/tone signal on the dedicated cable back to the multiswitch, and the multiswitch delivers the satA 102 signal to IRD 112A on dedicated cable 124. IRD 112B independently controls the output port that IRD 112B is coupled to, and thus may deliver a different voltage/tone signal to the multiswitch. The voltage/tone signal typically comprises a 13 Volts DC (VDC) or 18 VDC signal, with or without a 22 kHz tone superimposed on the DC signal. 13 VDC without the 22 kHz tone would select one port, 13 VDC with the 22 kHz tone would select another port of the multiswitch, etc. There can also be a modulated tone, typically a 22 kHz tone, where the modulation schema can select one of any number of inputs based on the modulation scheme. For simplicity and cost savings, this control system has been used with the constraint of 4 cables coming for a single feedhorn assembly 124, which therefore only requires the 4 possible state combinations of tone/no-tone and hi/low voltage.

To reduce the cost of the ODU 108, outputs of the LNBs 128 present in the ODU 108 can be combined, or "stacked," depending on the ODU 108 design. The stacking of the LNB 128 outputs occurs after the LNB has received and downconverted the input signal. This allows for multiple polarizations, one from each satellite 102-106, to pass through each LNB 128. So one LNB 128 can, for example, receive the Left Hand Circular Polarization (LHCP) signals from SatC 102 and SatB 104, while another LNB receives the Right Hand Circular Polarization (RHCP) signals from SatB 104, which allows for fewer wires or cables between the feedhorn assembly 124 and the multiswitch.

The Ka-band of downlink signals 120 will be further divided into two bands, an upper band of frequencies called the "A" band and a lower band of frequencies called the "B" band. Once satellites are deployed within system 100 to broadcast these frequencies, the various LNBs 128 in the feedhorn assembly 124 can deliver the signals from the Ku-band, the A band Ka-band, and the B band Ka-band signals for a given polarization to the multiswitch. However, current IRD 112 and system 100 designs cannot tune across this entire resulting frequency band without the use of more than 4 cables, which limits the usefulness of this frequency combining feature.

By stacking the LNB 128 inputs as described above, each LNB 128 typically delivers 48 transponders of information to the multiswitch, but some LNBs 128 can deliver more or less in blocks of various size. The multiswitch allows each output of the multiswitch to receive every LNB 128 signal (which is an input to the multiswitch) without filtering or modifying that information, which allows for each IRD 112 to receive more data. However, as mentioned above, current IRDs 112 cannot use the information in some of the proposed frequencies used for downlink signals 120, thus rendering useless the information transmitted in those downlink signals 120. Typically, an antenna reflector 122 is pointed toward the southern sky, and roughly aligned with the satellite downlink 120 beam, and then fine-tuned using a power meter or other alignment tools. The precision of such an alignment is usually not critical. However, additional satellites are being deployed that require more exacting alignment methods, and, without exacting alignment of the antenna reflector 122, the signals from the additional satellites will not be properly received, rendering these signals useless for data and video transmission.

It can be seen, then, that there is a need in the art for an alignment method for a satellite broadcast system that can be expanded to include new satellites and new transmission frequencies.

SUMMARY OF THE INVENTION

To minimize the limitations in the prior art, and to minimize other limitations that will become apparent upon reading and understanding the present specification, the present invention discloses a method for aligning a multi-satellite receiver antenna, and more specifically, a method, apparatus and system for aligning an antenna reflector with satellites in a satellite configuration.

A system in accordance with the present invention comprises an alignment mechanism, coupled to the reflector, wherein the alignment mechanism comprises adjustments in azimuth, elevation, and skew, wherein the alignment mechanism is used to provide a first alignment to the satellite configuration, and a tool, used to access a database, wherein the database, comprises data related to satellite configuration positional data, including a position of at least one satellite in the satellite configuration at a given point in time, data related to the antenna, including at least data related to an alignment mechanism coupled to the antenna, data related to polarizations and frequencies of signals being transmitted by the satellite configuration, and data related to the geoposition of the antenna being aligned, wherein the database calculates at least one offset for the alignment of the reflector, wherein the at least one offset is used to reposition the antenna using the alignment mechanism.

A tool in accordance with the present invention comprises at least one connector, coupled to a feedhorn assembly of the antenna, a divider, coupled to the at least one connector, for dividing signals received by the feedhorn assembly, a power supply, coupled to the at least one connector, for powering the feedhorn assembly of the antenna and for selecting a specific feedhorn of the feedhorn assembly, a tuner/demodulator section, coupled to the divider, for tuning to a specific signal and demodulating the specific signal, a processor, coupled to the tuner/demodulator, for processing the demodulated specific signal, and a display section, coupled to the processor, for displaying characteristics of the demodulated specific signal.

Such a tool optionally further comprises an input section, coupled to the processor, for inputting commands to the processor, a memory, coupled to the processor, for storing commands used by the processor, and a data port, coupled to the processor, for inputting electronic commands from an external source to the processor.

Other features and advantages are inherent in the system and method claimed and disclosed or will become apparent to those skilled in the art from the following detailed description and its accompanying drawings.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

In the following description, reference is made to the accompanying drawings which form a part hereof, and which show, by way of illustration, several embodiments of the present invention. It is understood that other embodiments may be utilized and structural changes may be made without departing from the scope of the present invention.

Overview

Figure 1:
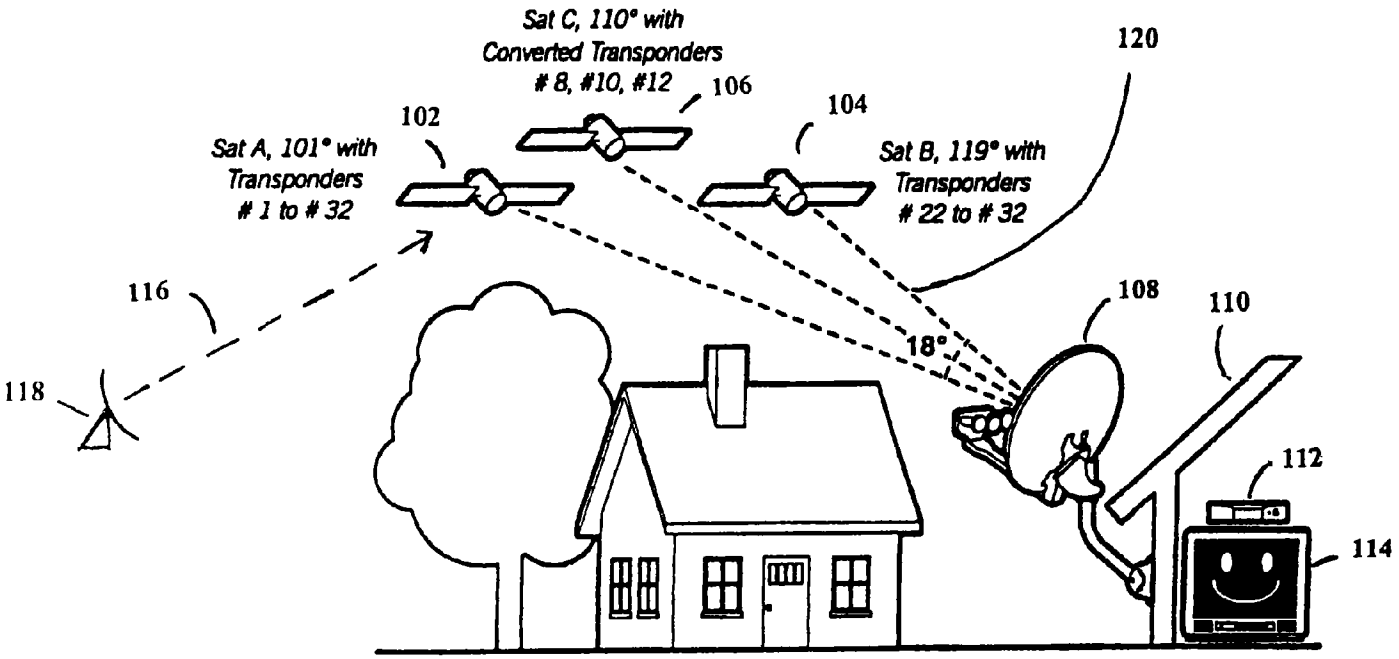
FIG. 1 illustrates a typical satellite television installation of the related art.
Figure 2:
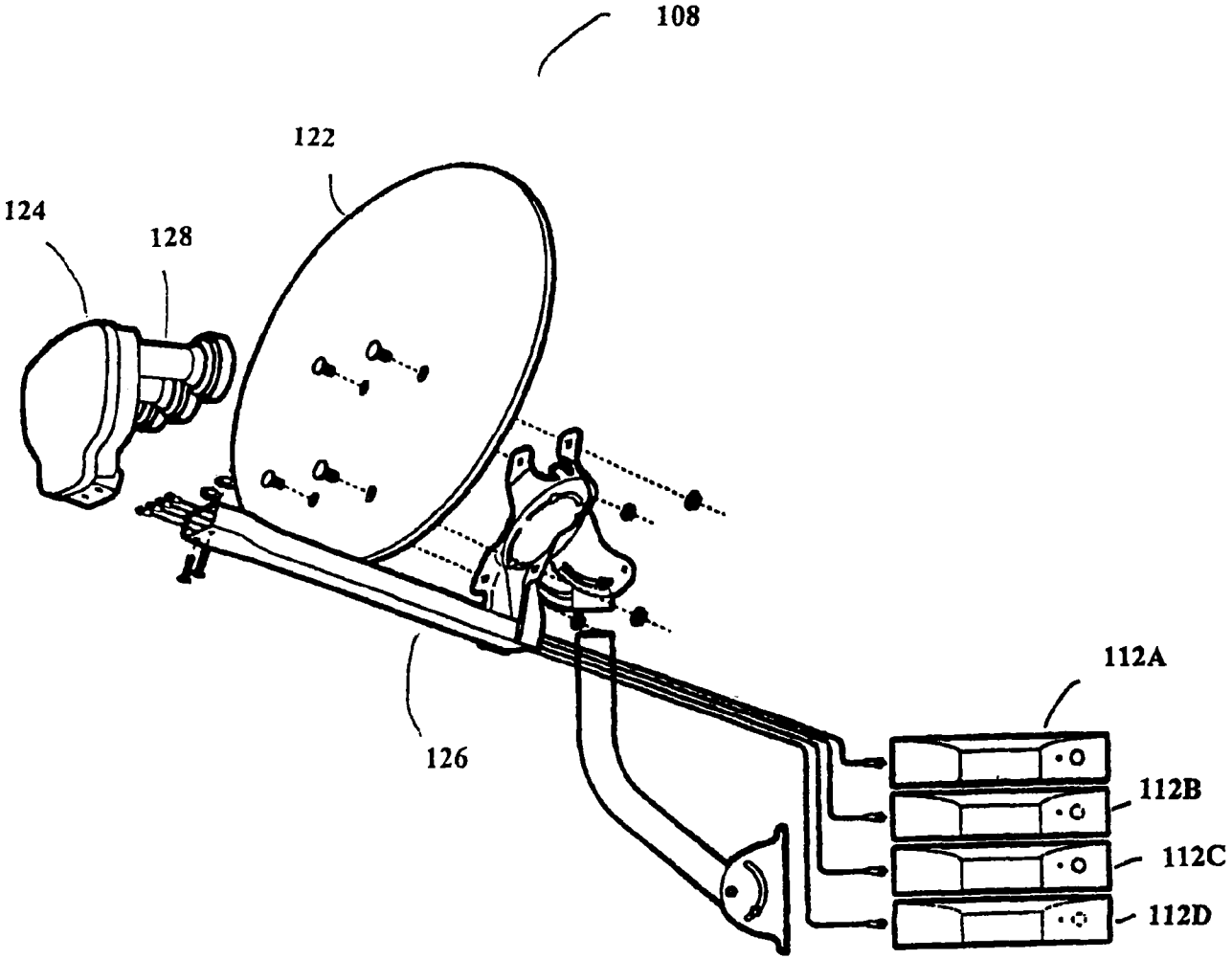
FIG. 2 illustrates a typical ODU of the related art.
Figure 3:
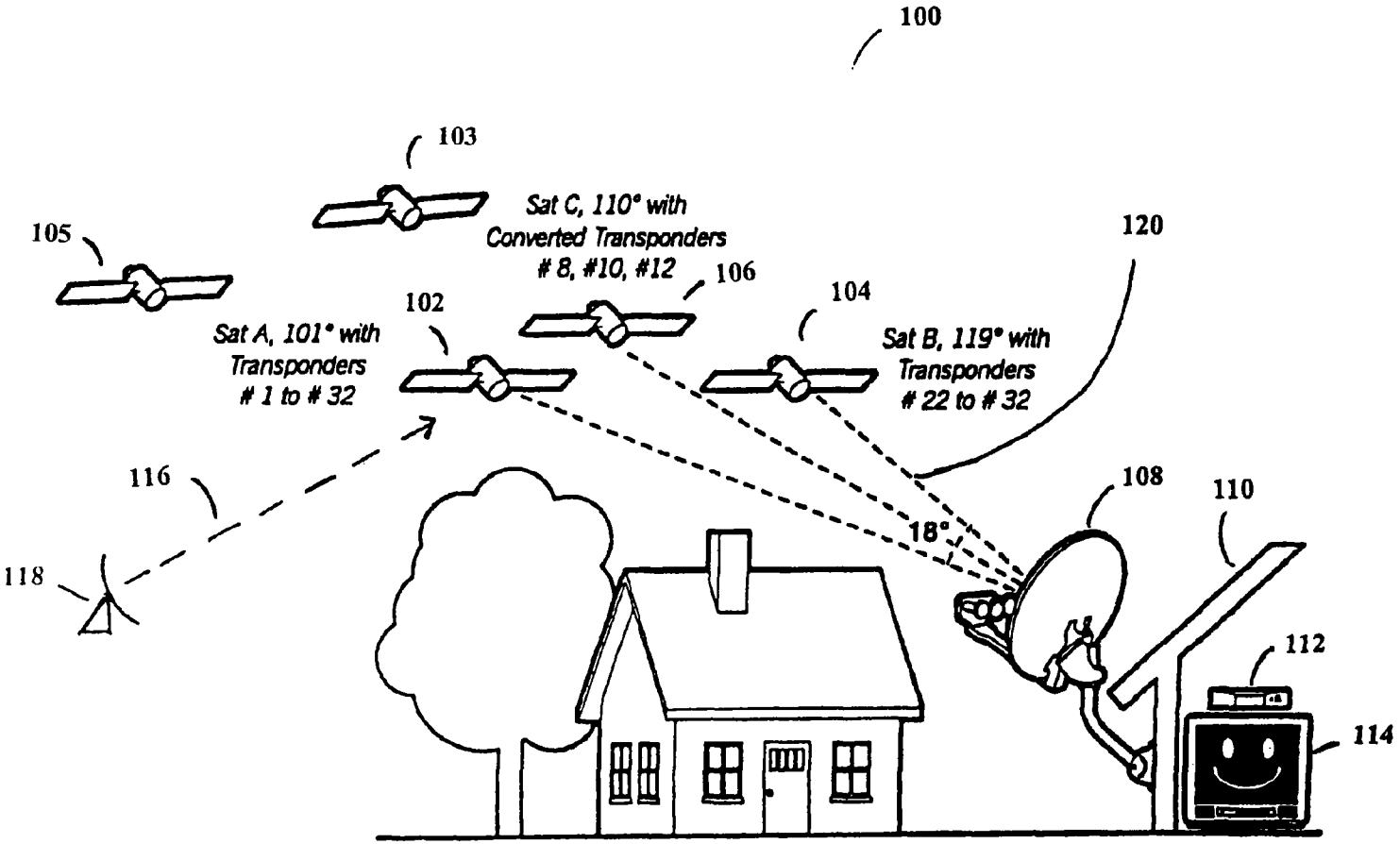
FIG. 3 illustrates a satellite constellation of the present invention.

FIG. 3 illustrates a satellite constellation of the present invention.

System 100 uses signals sent from Satellite A (SatA) 102, Satellite B (SatB) 104, and Satellite C (SatC) 106 that are directly broadcast to an Outdoor Unit (ODU) 108 that is typically attached to the outside of a house 110. Additionally, system 100 uses signals sent from satellites 103 and 105, which can be broadcast at a different frequency band than the signals sent by satellites 102-106 for use in system 100.

ODU 108 receives these signals and sends the received signals to IRD 112, which decodes the signals and separates the signals into viewer channels, which are then passed to television 114 for viewing by a user. There can be more than one satellite transmitting from each orbital location.

Satellites 102, 104, and 106 broadcasts downlink signals 120 in typically thirty-two (32) different frequencies, which are licensed to various users for broadcasting of programming, which can be audio, video, or data signals, or any combination. These signals are typically located in the Ku-band of frequencies, i.e., 11-18 GHz. Satellites 103 and 105 typically broadcast in the Ka-band of frequencies, i.e., 18-40 GHz, but typically 20-30 GHz.

The orbital locations of satellites 102-106 are fixed by regulation, so, for example, there is a satellite at 101 degrees West Longitude (WL), SatA 102; another satellite at 110 degrees WL, SatC 106; and another satellite at 119 degrees WL, SatB 104. Satellite 103 is located at 102.8 degrees WL, and satellite 105 is located at 99.2 degrees WL. Other satellites may be at other orbital slots, e.g., 72.5 degrees, 95 degrees, and other orbital slots, without departing from the scope of the present invention. The satellites are typically referred to by their orbital location, e.g., SatA 102, the satellite at 101 WL, is typically referred to as "101."

Figure 4:
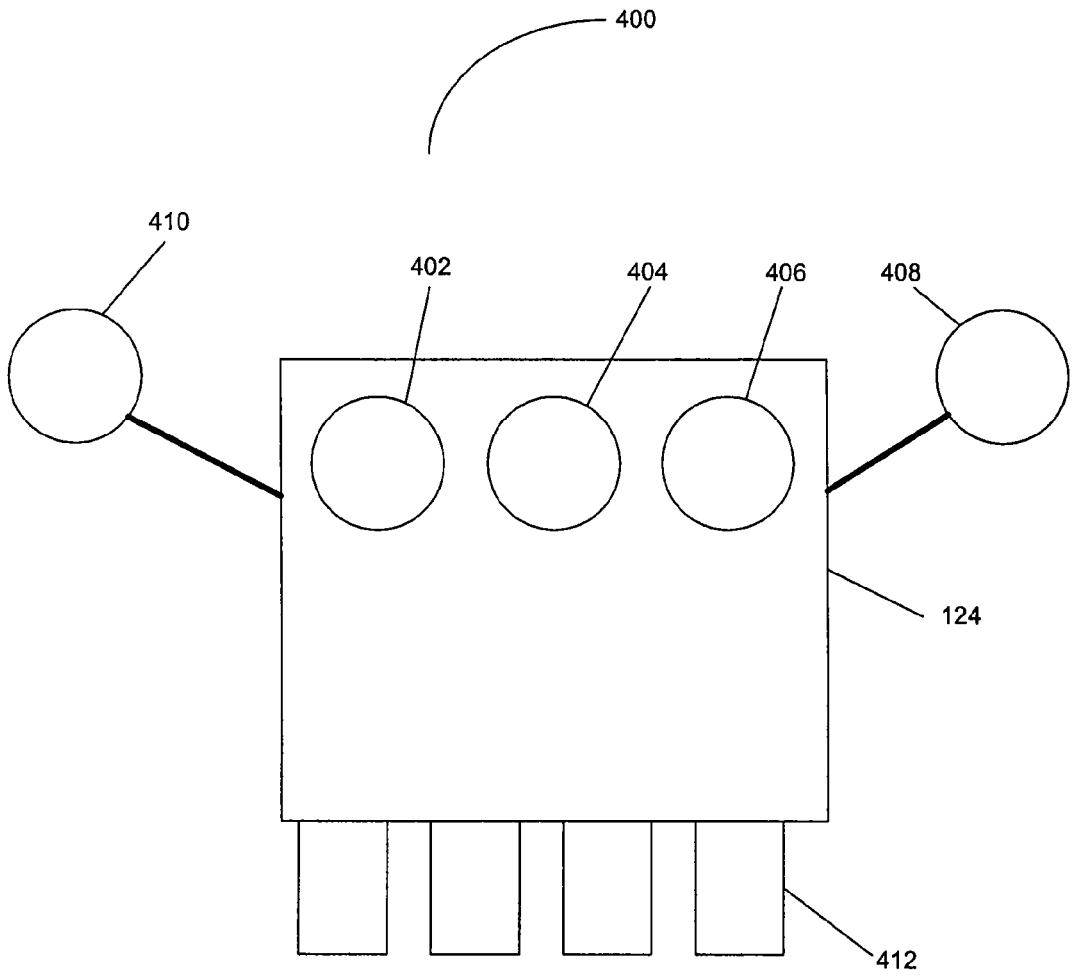
FIG. 4 illustrates a feedhorn/LNB assembly of the present invention.

FIG. 4 illustrates a feedhorn/LNB assembly of the present invention.

System 400 illustrates feedhorn assembly 124, which comprises feedhorns 402-406, optional feedhorns 408-410, and connectors 412. Feedhorns 402-406 receive Ka-band signals from satellites 103 and 105, and Ku-band signals from satellite 102. Optional feedhorns 408 and 410 receive Ku-band signals from satellite 104, 106, and other satellites present in system 100, if optional feedhorns 408 are present in system 400.

When system 100 uses the Ku-band signals from satellites 102, 104, and 106, the system 100 is much easier to align ODU 108 to receive downlink signals 120, because the beam patterns of the Ku-band downlink signals 120 are much larger than the Ka-band downlink signals 120 from satellites 103 and 105. Further, system 400 requires a more accurate alignment, because the Ka-band signals from satellites 103 and 105 are more susceptible to interferences that the Ku-band signals are at least partially immune from, e.g., weather, as well as having smaller beam patterns than the Ku-band downlink signals 120.

Error Sources

Figure 5:
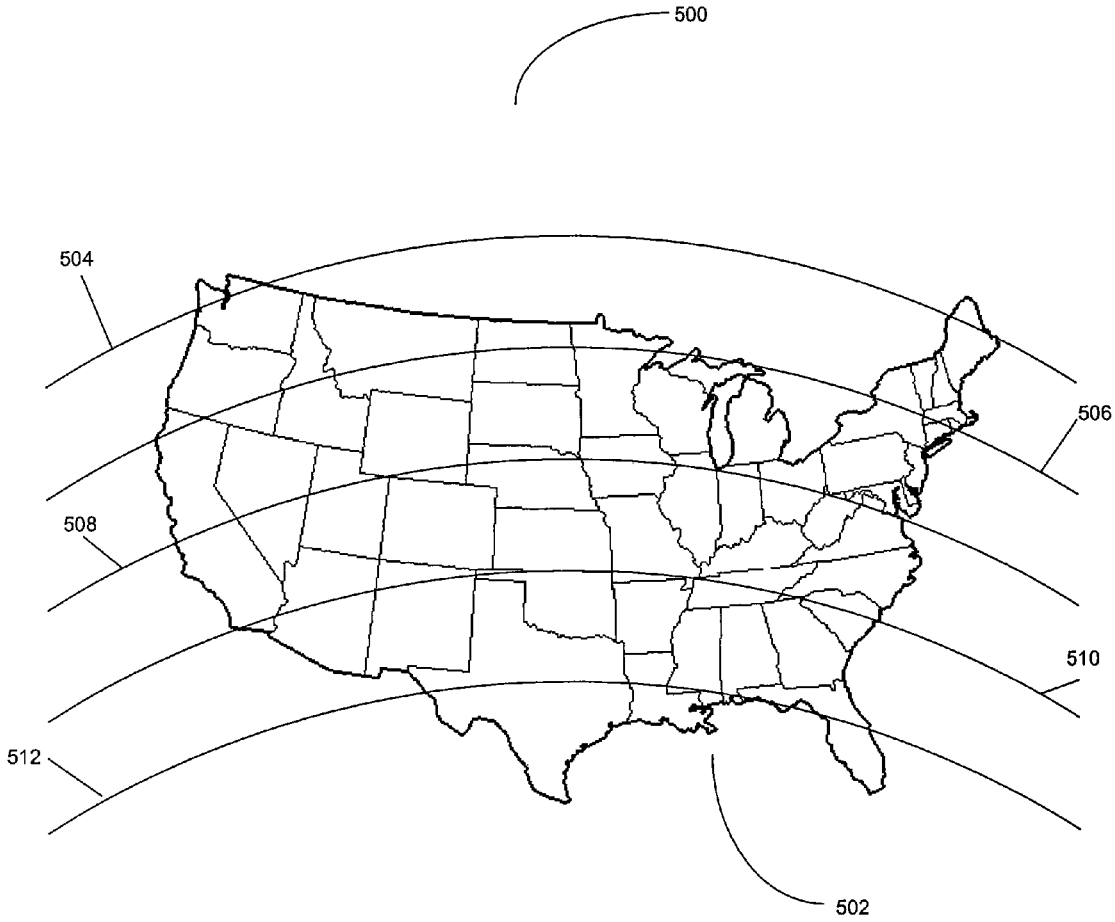
FIG. 5 illustrates the topocentric angle variation across the continental United States.

FIG. 5 illustrates the topocentric angle variation across the continental United States.

Map 500 shows the Continental United States (CONUS) 502, as well as topocentric lines 504-512. Each satellite 102-106 is in geosynchronous orbit, as if it were stationary with respect to a given point on the Earth, which is based on an imaginary observer at the center of the Earth. However, that imaginary point of stationary motion, is only a single point, rather than the large geographical area CONUS 502 represents. As such, topocentric lines 504-512 illustrate the difference in angle between the stationary point (typically located on the equator) and the locations within CONUS 502.

Each topocentric line 504-512 illustrates a change in the topocentric position (the position of the satellites 102-106 as seen from the Earth's surface) as a function of latitude. As the topocentric lines 504-512 move north, e.g., line 504 is farther north than line 506, the topocentric angle becomes smaller. For example, and not by way of limitation, topocentric line 504 may indicate a topocentric correction angle of 1.95 degrees, meaning that an ODU 108 residing exactly on line 504 must have its alignment corrected by 1.95 degrees downward (toward the Earth's surface) to properly point at satellites 102-106. However, an ODU residing on line 512 requires a 2.05 degree correction downward.

Alignment of the ODU 108 uses this limited number of fixed topocentric correction values regardless of where the ODU 108 is actually located. For example, and not by way of limitation, an installer that was installing an ODU 108 somewhere in CONUS 502 between lines 504 and 506 would just choose the value associated with the line closer to the location of the ODU 108, rather than selecting an exact value or using alignment tools to properly determine the topocentric angle for that CONUS 502 location.

Figure 6A:
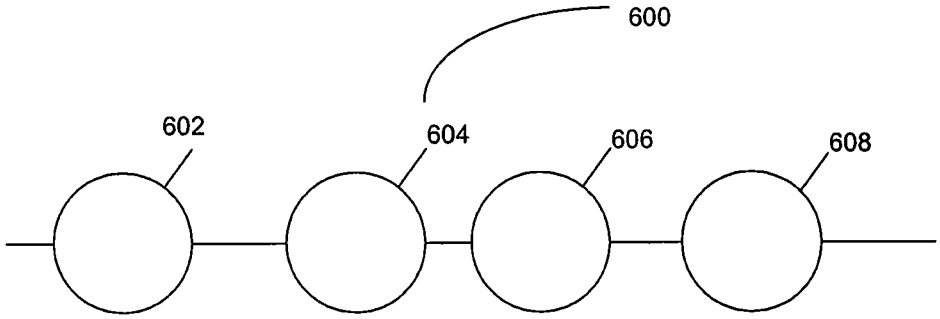
FIGS. 6A-6B illustrate orbital slot and stationkeeping errors.
Figure 6B:
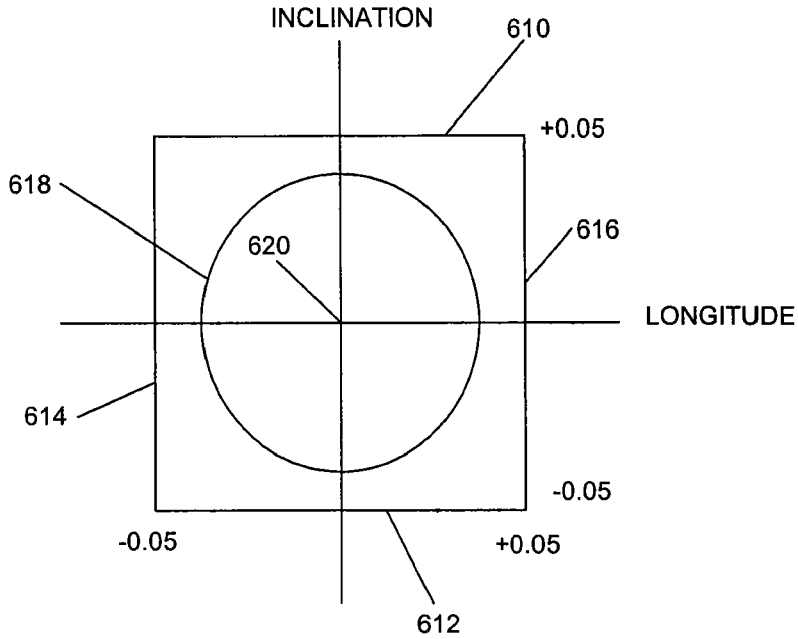

FIGS. 6A-6B illustrate orbital slot and stationkeeping errors.

FIG. 6A illustrates several satellites at a given orbital slot 600. Each satellite 602-606 transmits downlink signals 120 that are received by ODU 108. For example, and not by way of limitation, if orbital slot 600 is the slot at 101 degrees WL, then satellites 602-608 have been referred to previously herein as satellite 102. However, satellites 602-608 are at physically different locations, typically satellite 602 is at a nominal position of 100.8 degrees WL, satellite 604 is at a nominal position of 101.0 degrees WL, satellite 606 is at a nominal position of 101.1 degrees WL, and satellite 608 is at a nominal position of 101.25 degrees WL. Depending on which satellite is used to align ODU 108, several tenths of a degree of error can be introduced into such an alignment procedure.

FIG. 6B shows the standard stationkeeping boundaries, specifically inclination boundaries 610 and 60 and longitude boundaries 614 and 616. Satellites typically move within a given period within boundary 618, which is bounded by the boundaries 610-616. Typically, boundaries 610-616 are plus or minus 0.05 degrees about a nominal location 620 for a given satellite 102-106, but the boundaries may be looser for a given orbital slot that has fewer satellites located at that orbital slot. Again, depending on where the satellite 102-106 is located within the boundaries 610-618 during the alignment procedure, errors in alignment can be introduced.

Figure 7:
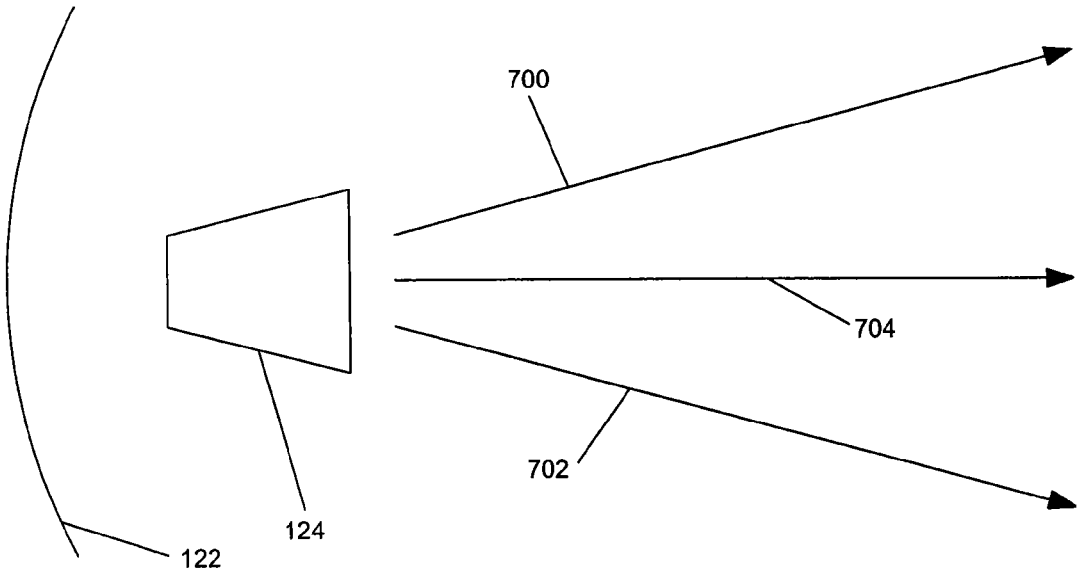
FIG. 7 illustrates polarization squint errors from a single offset reflector.

FIG. 7 illustrates polarization squint errors from a single offset reflector. Reflector 122 and feedhorn assembly 124 are shown. Three alignments 700-704 are also shown, where alignment 700 is a peak for the LHCP signal from a given satellite 102-106, alignment 702 is a peak for the RHCP signal from a given satellite 102-106, and alignment 704 is a peak for a linear polarization from a given satellite 102-106. Since reflector 122 must reflect both RHCP and LHCP signals from multiple satellites 102-106, it will depend on which polarization is selected for alignment (e.g., which alignment 700 or 702 signal is used to align ODU 108), as well as which satellite 102-106 are selected as described above, as to where the ODU 108 uis actually aligned.

Further, there are variations between ODU manufacturer's models in terms of alignment control and adjustment mechanisms, as well as tolerances and differences for feed horn 128 spacings, and, as such, many additional errors may be introduced into an alignment procedure without taking the foregoing into account.

Feedback Approach

The present invention proposes a real-time or semi-real-time feedback approach to determine the proper antenna offset for a given installation of an ODU 108.

An ODU is initially aligned with a given orbital slot (typically 101 degrees WL). This alignment is typically done by moving the ODU 108 in azimuth, elevation, and tilt to maximize received power at the ODU 108. When the position for the ODU 108 receiving maximum power is found (also called "peaking the meter"), a customized or semi-customized offset procedure is undertaken to maximize not only the power that has been received from one orbital slot, but from other orbital slots, based on CONUS 502 location (to remove topocentric errors), stationkeeping statistics (to remove stationkeeping errors), transponder used for alignment (to remove orbital slot errors), offsets (to remove beam squint errors), and model variances to assist installers in making a proper alignment to the satellites 102-106.

Figure 8:
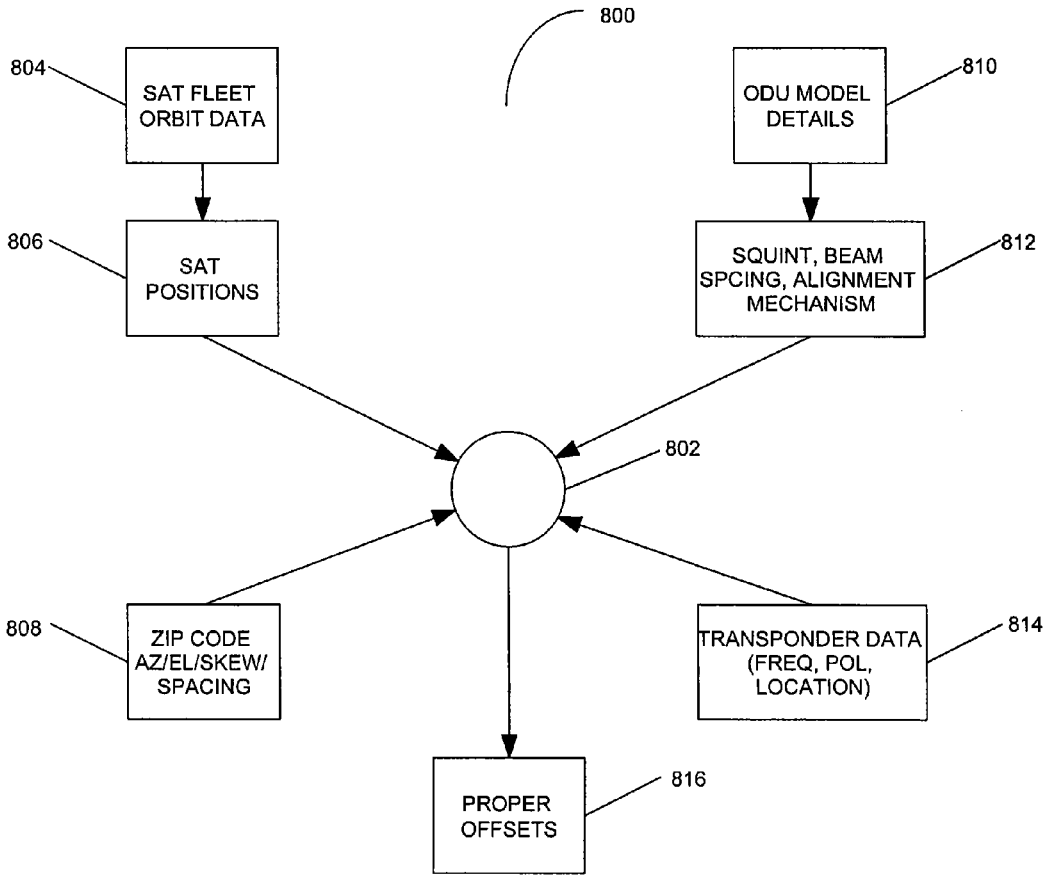
FIG. 8 illustrates a flow diagram to shown the feedback model of the present invention.

FIG. 8 illustrates a flow diagram to shown the feedback model of the present invention.

System 800 illustrates database 802, with satellite fleet data 804, satellite positions 806, zip code input 808, ODU model details 810, including mechanism and tolerances 812, and transponder data 814 acting as inputs to database 802, with proper offsets 816 as an output from database 802.

An installer using system 800 would begin an installation by mounting an ODU 108 with a set skew on a house 110, and peak the antenna on a single transponder from one of the satellites 102-106 (typically satellite 102). Once that has taken place, the installer then uses a tool, e.g., a telephone, a computer, or a tool attached to the ODU 108, etc., to call or access database 802, and provides database 802 with the zip code 808 where the installation is taking place, the time of the installation, the ODU model details 810 of the ODU 108 being installed, including any special details 814 if needed, and the frequency or transponder 814 that is being used to align ODU 108. Database 802 then uses the satellite fleet data 804, including, if necessary, the satellite 102-106 positions at the time of the install or at a time most recent to the installation, and the data sent by the installer, to sent the proper offsets 816 back to the installer such that these offsets can be used to properly align the ODU 108 at the CONUS 502 position for a given time.

In essence, database 802 acts as a centralized repository for all of the data for all ODU model details 810, satellite orbit data 804 and 806, topospheric correction lines 504-512 as well as interpolations of the lines 504-512, and alignment transponder data 514, to calculate the proper offsets 816 for a given installation of an ODU 108 anywhere in CONUS 502, or, for that matter, anywhere in the world.

Such a system removes intensive calculations that are necessary for proper alignment of ODU 108 from being performed by the installer, and, instead, are performed consistently by a centralized location, namely, database 802.

After using proper offsets 816 to adjust the ODU 108 alignment, the installer then verifies that the offsets and remainder of the installation of ODU 108 is correct.

Such a method can be implemented in several ways. For example, and not by way of limitation, the number of feedhorns 128 can vary, as can the number of locations for satellites 102-106 that are used for alignment. A minimum number of 1 location and/or 1 feedhorn 128 may have one installation technique and/or proper offset 816, while a Ka-Ku-Ka specific feedhorn assembly 128 may have a different offset 816. Further, the installer may peak the meter on multiple transponders, whether it is on a single satellite 102-106 or multiple satellites 102-106.

Database 802 may also be located at a centralized location, and database 802 may perform all of the calculations for the installer. However, such a database can be located in a handheld tool that the installer uses, such as a tool that is attached to the power meter used to align the ODU 108, or another tool, which can accept inputs 804-814 from the installer and/or other data sources. As such, the database 802, and any associated calculations, can be performed locally to the installer when such a tool is available.

Calculations and/or database 802 inputs may not require all inputs from installers in the entire CONUS 502 region. For example, although the data items that may introduces errors comprise topocentric angles based on location of installation (see FIG. 5), specific antenna feed positions (see FIG. 4), specific antenna squint (see FIG. 7), satellite locations (see FIGS. 3 and 6A), and satellite station keeping positions (see FIG. 6B), not all of these data points may be required for a given proper offset 816 calculation for a given ODU installation.

The feedback approach of the present invention uses the proper offsets 816 to change the azimuth, elevation, and skew (rotation) of the ODU 108 based on one or more of the above-identified data inputs.

Simultaneous Alignment Verification Tool

Even if the above method is used, installations are typically checked to ensure that the ODU is properly receiving signals 120 from each satellite 102-106, including both Ku-band and Ka-band satellites. The present invention further comprises a tool to verify the reception of at least one signal 120 from every satellite 102-106 that is expected for a given ODU 108 (i.e., there may be some satellites 102-106 that a given ODU 108 is not designed to receive signals from, and, as such, such signals would not be expected), and, further, such a tool in accordance with the present invention can also help to optimize the installation of a given ODU 108.

The present inventive concept takes advantage of multiple receivers in a test device, tuned as required to receive signals from multiple satellites 102-106 as well as multiple orbital slots, simultaneously. A device in accordance with the present invention can be pre-programmed or pre-loaded with information about satellite positions, polarizations, frequencies, ODU characteristics, geoposition of the ODU and/or tool, etc. such that an installer merely needs to attach the tool to a specific output of the ODU 108 to verify the reception of signals. The device can be outfitted with indicators to show an installer a pass/fail indication (green and red LEDs, for example) or, can be more sophisticated and provide assistance to the installer for adjusting the ODU 108 alignment (via power meters, other color LEDs, etc).

Figure 9:
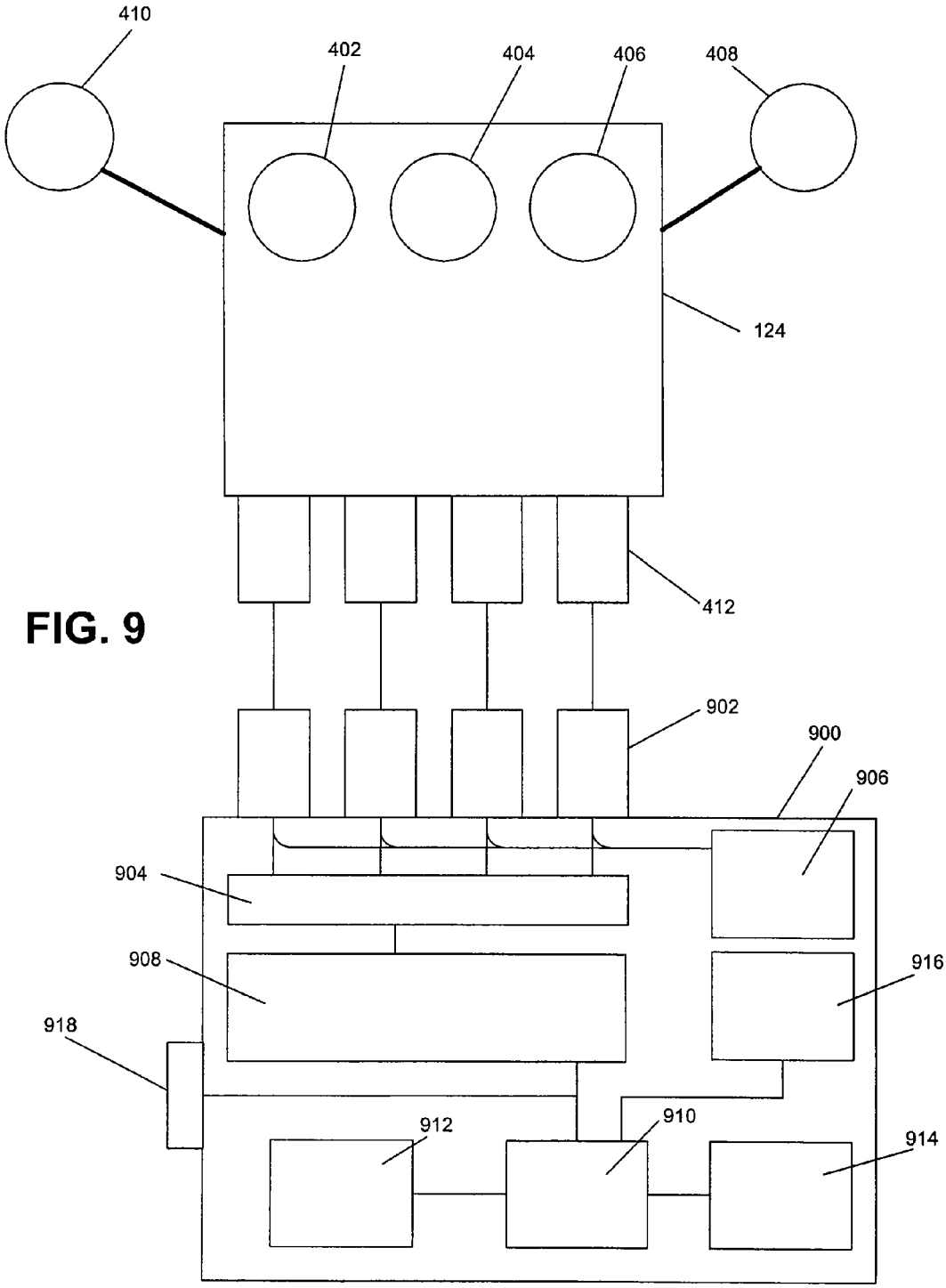
FIG. 9 illustrates a block diagram of an embodiment of an alignment tool in accordance with the present invention.

FIG. 9 illustrates a block diagram of an embodiment of an alignment tool in accordance with the present invention.

Tool 900 is shown connected to outputs 412 from feedhorn assembly 124 at connectors 902. Of course, connector 902 can be coupled to the output of a multiswitch, or otherwise connected to assembly 124, without departing from the scope of the present invention.

Connectors 902 are coupled to a divider/switch 904, as well as to a power supply 906, that supplies commands to the feedhorn assembly 124, i.e., 13/18 V, with or without 22 kHz tone, to select various feedhorns 128, as well as powering the feedhorn assembly 124 with direct current power (typically 5 volts DC).

Divider 904 is coupled to tuner/demodulator section 908, which is controlled by CPU 910. CPU 910 is also connected to memory 912, input section 914, display section 916, and data port 918. The input section allows an installer to input commands to the CPU 910, the memory stores commands used by the CPU 910, and the data port 918 accepts and inputs electronic commands from an external source to the CPU 910.

As the signals enter divider 904, they are sent to the tuner/demodulator section 908, where CPU 901 commands tuner/demodulator section 908 to tune to a channel that is known to be on a given satellite 102-106, e.g., satellite 102. That signal is demodulated and then checked by using display section 916, whether it is a power meter or LED display, to determine whether or not the signal from the given satellite 102-106 is being properly received in terms of power, etc. Input section 814, which can be a keypad or other input device, allows the operator of tool 900 to request a specific channel, request multiple channels from a given satellite, or provide other inputs to tool 900. Data port 918 allows the user of tool 900 to connect tool 900 to a computer or other device for electronic input of data to be stored in memory 912 and used by CPU 910 during testing of the ODU 108 and feedhorn assembly 124. Tool 900 can either automatically or manually step through multiple channels from every satellite 102-106 to ensure that signals from each satellite 102-106 is being received, and display section 916 can help diagnose the signals coming from satellites 102-106 to make sure each signal is at an optimum power level, which would indicate that ODU 108 is properly aligned.

Of course, tool 900 can take alternative embodiments, e.g., where different numbers of satellites or orbital locations are checked, different numbers of connectors 902 are used or even present on tool 900, and tool 900 can be a part of or connected to another assembly, e.g., an IRD 112 or other module used in system 100, instead of being connected directly to ODU 108 and/or feedhorn assembly 124. The number of tuners and/or demodulators in tuner/demodulator section 908 can vary, typically such number is 4 to 8, but can be from 1 to any number as desired.

The types of displays in display section 916 can also vary, from analog meters to colored LEDs to a text display, to a combination of different displays, depending on the desired tool 900 functionality.

Conclusion

In summary, the present invention comprises a method, apparatus and system for aligning an antenna reflector with satellites in a satellite configuration. A system in accordance with the present invention comprises an alignment mechanism, coupled to the reflector, wherein the alignment mechanism comprises adjustments in azimuth, elevation, and skew, wherein the alignment mechanism is used to provide a first alignment to the satellite configuration, and a tool, used to access a database, wherein the database, comprises data related to satellite configuration positional data, including a position of at least one satellite in the satellite configuration at a given point in time, data related to the antenna, including at least data related to an alignment mechanism coupled to the antenna, data related to polarizations and frequencies of signals being transmitted by the satellite configuration, and data related to the geoposition of the antenna being aligned, wherein the database calculates at least one offset for the alignment of the reflector, wherein the at least one offset is used to reposition the antenna using the alignment mechanism.

A tool in accordance with the present invention comprises at least one connector, coupled to a feedhorn assembly of the antenna, a divider, coupled to the at least one connector, for dividing signals received by the feedhorn assembly, a power supply, coupled to the at least one connector, for powering the feedhorn assembly of the antenna and for selecting a specific feedhorn of the feedhorn assembly, a tuner/demodulator section, coupled to the divider, for tuning to a specific signal and demodulating the specific signal, a processor, coupled to the tuner/demodulator, for processing the demodulated specific signal, and a display section, coupled to the processor, for displaying characteristics of the demodulated specific signal.

Such a tool optionally further comprises an input section, coupled to the processor, for inputting commands to the processor, a memory, coupled to the processor, for storing commands used by the processor, and a data port, coupled to the processor, for inputting electronic commands from an external source to the processor.

It is intended that the scope of the invention be limited not by this detailed description, but rather by the claims appended hereto and the equivalents thereof The above specification, examples and data provide a complete description of the manufacture and use of the composition of the invention. Since many embodiments of the invention can be made without departing from the spirit and scope of the invention, the invention resides in the claims hereinafter appended and the equivalents thereof.

What is claimed is:

1. A tool for aiding in alignment of a reflector of an antenna with a satellite configuration comprising a plurality of satellites, comprising:

at least one connector, coupled to a feedhorn assembly of the antenna;

a divider, coupled to the at least one connector, for dividing signals received by the feedhorn assembly;

a power supply, coupled to the at least one connector, for powering the feedhorn assembly of the antenna and for selecting a specific feedhorn of the feedhorn assembly;

a tuner/demodulator section, coupled to the divider, for tuning to a specific signal from a first satellite in the satellite configuration and demodulating the specific signal;

a processor, coupled to the tuner/demodulator, for processing the demodulated specific signal, wherein the processor processes the demodulated specific signal using positional data from at least one other satellite in the satellite configuration; and a display section, coupled to the processor, for displaying characteristics of the demodulated specific signal, wherein the tool aligns the reflector of the antenna with the first satellite and the at least one other satellite in the satellite configuration such that the antenna receives a signal from the first satellite and simultaneously receives a signal from the at least one other satellite in the satellite configuration.

2. The tool of claim 1, further comprising an input section, coupled to the processor, for inputting commands to the processor.

3. The tool of claim 2, further comprising a memory, coupled to the processor, for storing commands used by the processor.

4. The tool of claim 3, further comprising a data port, coupled to the processor, for inputting electronic commands from an external source to the processor.

5. The tool of claim 1, wherein the processor processes a plurality of demodulated specific signals simultaneously.

6. The tool of claim 5, wherein the plurality of demodulated specific signals are transmitted by a plurality of satellites in the satellite configuration.

7. The tool of claim 6, wherein the display section indicates adjustments needed for the reflector based on characteristics of the plurality of demodulated specific signals.

8. The tool of claim 7, wherein the characteristics comprise at least a power level of each of the plurality of demodulated specific signals.

9. The tool of claim 1, wherein the processor processes a plurality of demodulated specific signals in a sequential manner.

10. The tool of claim 9, wherein the plurality of demodulated specific signals are transmitted by a plurality of satellites in the satellite configuration.

11. An alignment tool for aligning a reflector of an antenna with a satellite configuration comprising a plurality of satellites, comprising:

at least one connector coupled to the antenna;

a switch for selecting a specific satellite signal;

a tuner/demodulator section, coupled to the switch, for tuning to a specific portion of the specific satellite signal from a first satellite in the satellite configuration and for demodulating the specific portion;

a processor, coupled to the tuner/demodulator, for processing the demodulated specific portion, wherein the processor processes the demodulated specific portion using positional data from at least one other satellite in the satellite configuration; and a display section, coupled to the processor, for displaying characteristics of the demodulated specific portion, wherein the tool aligns the reflector of the antenna with the first satellite and the at least one other satellite in the satellite configuration such that the antenna receives a signal from the first satellite and simultaneously receives a signal from the at least one other satellite in the satellite configuration.

12. The alignment tool of claim 11, further comprising a memory, coupled to the processor, for storing commands used by the processor.

13. The alignment tool of claim 12, further comprising a data port, coupled to the processor, for inputting electronic commands from an external source to the processor.

14. The alignment tool of claim 11, wherein the processor processes a plurality of demodulated specific portions in a specific order.

15. The alignment tool of claim 14, wherein the plurality of demodulated specific portions are transmitted by a plurality of satellites in the satellite configuration.

16. The alignment tool of claim 15, wherein the specific order selects a satellite signal from each of the satellites in the satellite configuration.

17. The alignment tool of claim 11, wherein the display section indicates a condition of the demodulated specific portion.

18. An alignment tool for aligning a reflector of an antenna with a satellite configuration comprising a plurality of satellites, comprising:

means for selecting a specific satellite signal from a first satellite in the satellite configuration;

means for tuning to a specific portion of the specific satellite signal;

a processor, coupled to the selecting means and tuning means, for processing the specific portion using positional data from at least one other satellite in the satellite configuration; and a display section, coupled to the processor, for displaying characteristics of the demodulated specific portion such that the displayed characteristics indicate alignment of the reflector of the antenna with the first satellite and at least one other satellite in the satellite configuration.

19. The alignment tool of claim 18, wherein the processor processes a plurality of specific portions in a specific order.

20. The alignment tool of claim 19, wherein the plurality of specific portions are transmitted by a plurality of satellites in the satellite configuration.

* * * * *